US007070305B2

(12) United States Patent
Chen

(10) Patent No.: US 7,070,305 B2
(45) Date of Patent: Jul. 4, 2006

(54) ROTATION-CONTROLLED LAMP FOR CONTROLLING ACTUATION AND DE-ACTUATION OF THE LAMP

(76) Inventor: Meiric Chen, 235 Chung - Ho Box 8-24, Taipei (TW)

( * ) Notice: Subject to any disclaimer, the term of this patent is extended or adjusted under 35 U.S.C. 154(b) by 74 days.

(21) Appl. No.: 10/861,981

(22) Filed: Jun. 5, 2004

(65) Prior Publication Data

US 2005/0270777 A1 Dec. 8, 2005

(51) Int. Cl.
*F21V 23/00* (2006.01)

(52) U.S. Cl. ..... 362/295; 362/269; 362/384; 362/395; 362/411; 362/427

(58) Field of Classification Search ..... 362/269, 362/295, 395, 384, 411, 427
See application file for complete search history.

(56) References Cited

U.S. PATENT DOCUMENTS 2,014,054 A * 9/1935 Rood et al. ..... 362/411
2,668,905 A * 2/1954 Morin ..... 362/395
2,706,770 A * 4/1955 Morin ..... 362/395
2,790,041 A * 4/1957 Hanssler ..... 200/61.58 R
2,878,373 A * 3/1959 Bramming ..... 362/395
2,935,603 A * 5/1960 Greggains ..... 362/395
3,147,928 A * 9/1964 Carpenter ..... 362/394
5,023,522 A * 6/1991 Mansour ..... 315/291
2005/0157496 A1* 7/2005 Chen ..... 362/243

* cited by examiner

*Primary Examiner*—Thomas M. Sember
*Assistant Examiner*—Adam C. Rehm

(57) ABSTRACT

A rotation-controlled device for controlling actuation and de-actuation of the lamp comprises an upper cover; an arc strip protruded from an inner surface of the upper cover; a seat installed below the upper cover by using a connector; a button installed to the seat and resisting against the arc strip; the button being pushed to rotate by the arc strip; and a light adjuster installed below the button and aside the locking piece; the actuation of the light adjuster being controllable by the button. A bearing is installed below the upper cover and between the connector and the upper cover. A bottom cover is installed below the seat. The arc strip has teeth and the button has teeth. The one side of the arc strip has a sticky surface and a periphery of the button has another sticky surface.

4 Claims, 8 Drawing Sheets

ROTATION-CONTROLLED LAMP FOR CONTROLLING ACTUATION AND DE-ACTUATION OF THE LAMP

FIELD OF THE INVENTION

The present invention relates to lamp control device, and particular to a rotation-controlled lamp for controlling actuation and de-actuation of the lamp wherein a light adjuster is installed within the lamp seat and the actuation and de-actuation of the lamp can be achieved by rotating an upper cover. Thereby, the present invention can provide the lamp seat with a beautiful outlook.

BACKGROUND OF THE INVENTION

In the conventional lamp control, referring to FIG. 1, a light adjuster 61 is installed within a middle section of a lamp rod 62. The lamp rod has an upper section and a lower section. A round cylinder 63 is screwed to the lamp rod. A connection of the lamp rod 62 is installed with a long slot 64. The light adjuster 1 is installed within the long slot 64. Then the lamp rod 62 is locked to the round cylinder 63. Then the light adjuster 1 is positioned to the lamp rod 65. However, above mentioned structure has the following defects. Firstly, the light adjuster 1 is positioned to the long slot 64 and is locked by the lamp rod 62 and the round cylinder 63. The user can actuate and de-actuate the lamp by manually adjust the light adjuster 1. After the lamp is used for a longer time, the light adjuster 1 will release or vibrate and is easy to be destroyed. Furthermore, the button of the light adjuster is small. However, this is difficult to the children or some disablers. Moreover, the light adjuster 61 is installed at a middle section of the lamp rod 62, the design of the lamp 65 is confined and thus the appearance of the lamp seat is limited. Moreover, the installation and positioning of the light adjuster 61 is time and labor wasted.

SUMMARY OF THE INVENTION

Accordingly, the primary object of the present invention is to provide a rotation-controlled device for controlling actuation and de-actuation of the lamp, wherein the actuation of the lamp can be controlled by operating an upper cover so that user can operate it easily and conveniently. Moreover, the present invention has a beautiful outlook.

The rotation-controlled lamp for controlling actuation and de-actuation of the lamp comprises an upper cover; an arc strip protruded from an inner surface of the upper cover; a seat installed below the upper cover by using a connector; a button installed to the seat and resisting against the arc strip; the button being pushed to rotate by the arc strip; and a light adjuster installed below the button and aside the locking piece; the actuation of the light adjuster being controllable by the button. A bearing is installed below the upper cover and between the connector and the upper cover. A bottom cover is installed below the seat. The arc strip has teeth and the button has teeth. The one side of the arc strip has sticky surface and a periphery of the button has sticky surface.

The various objects and advantages of the present invention will be more readily understood from the following detailed description when read in conjunction with the appended drawing.

DETAILED DESCRIPTION OF THE INVENTION

Figure 1:
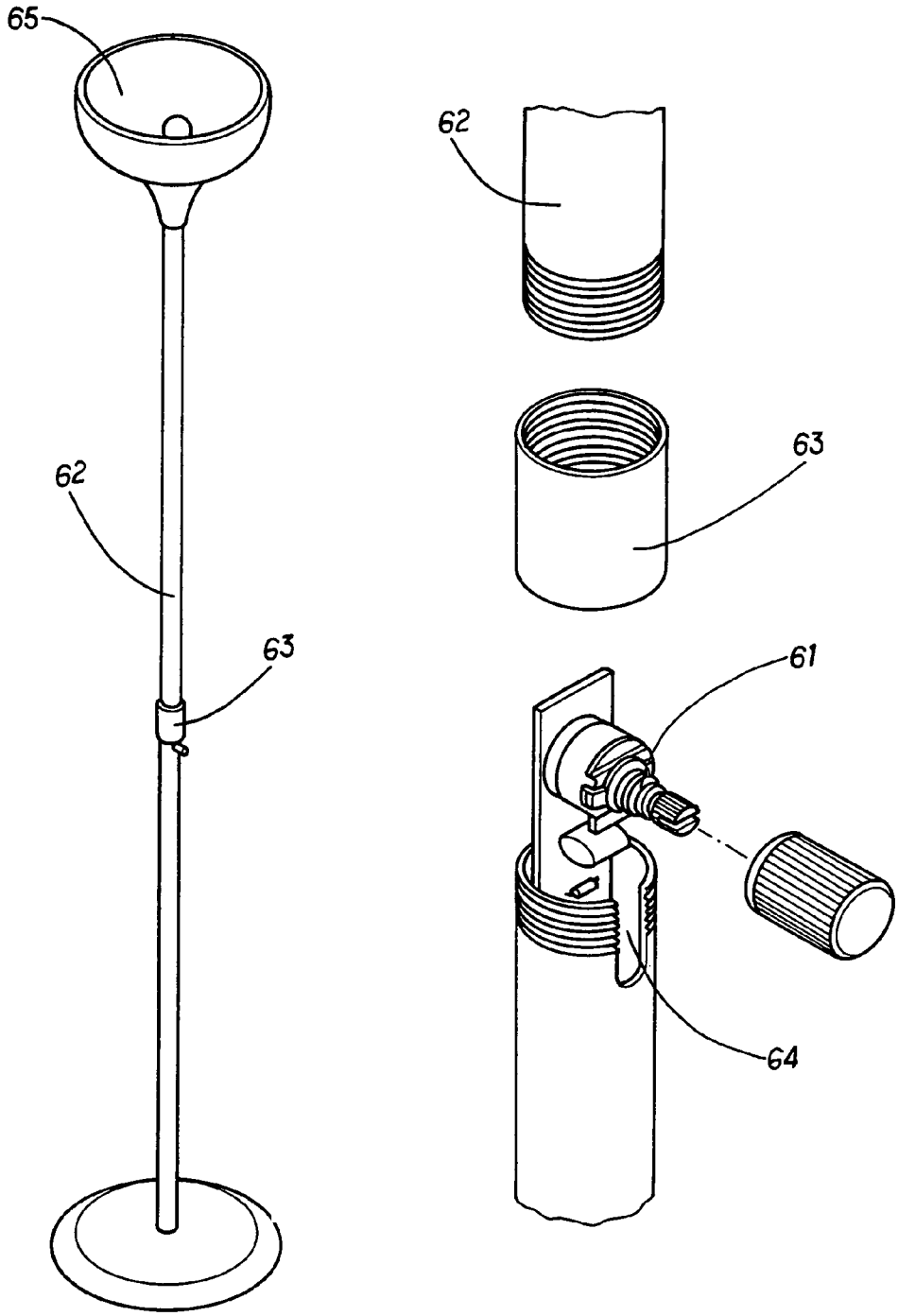
FIG. 1 PRIOR ART
FIG. 1 is a schematic view about the lamp rod and the light adjuster of the prior art.
Figure 2:
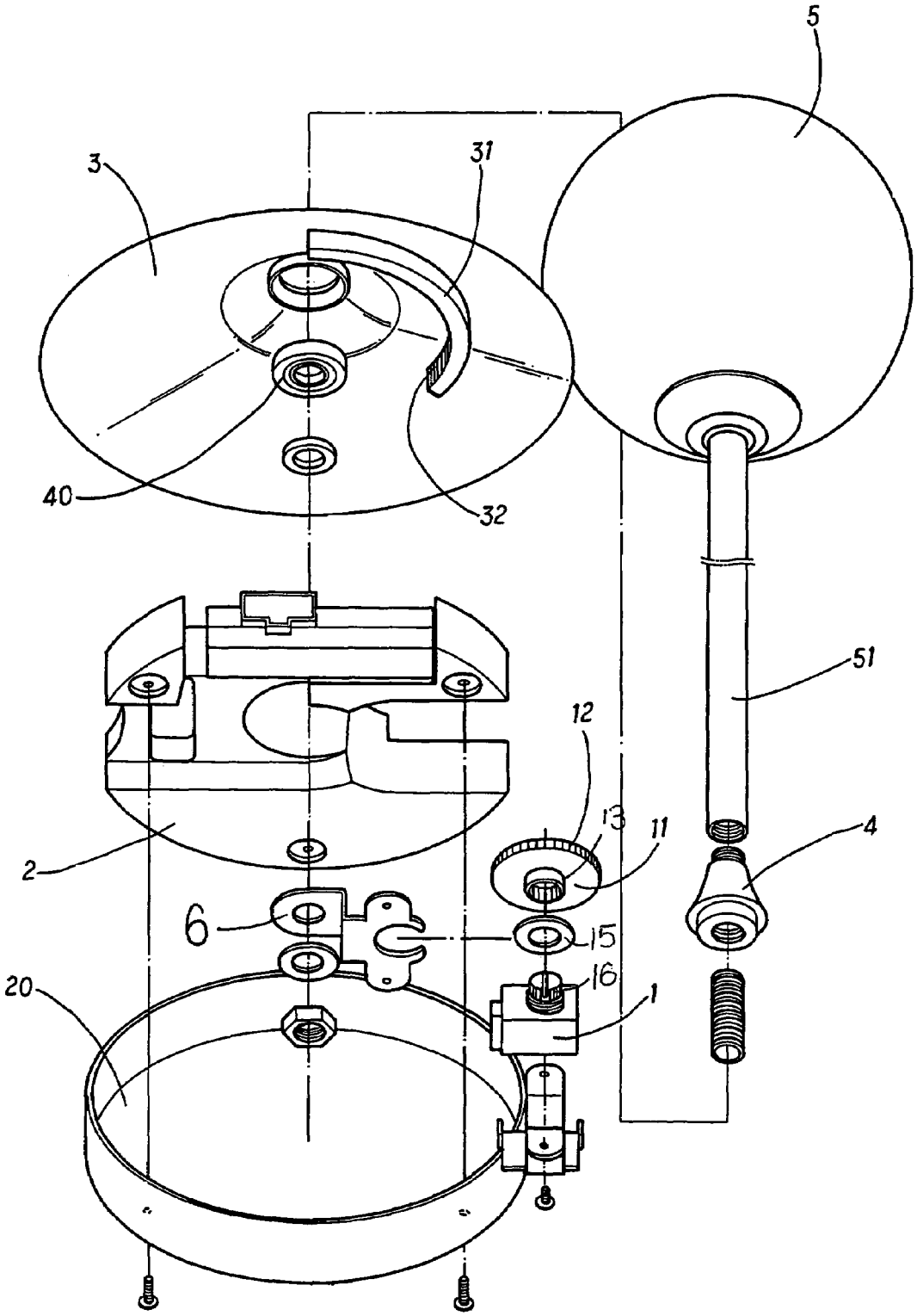
FIG. 2 is an exploded perspective view of the present invention.
Figure 3:
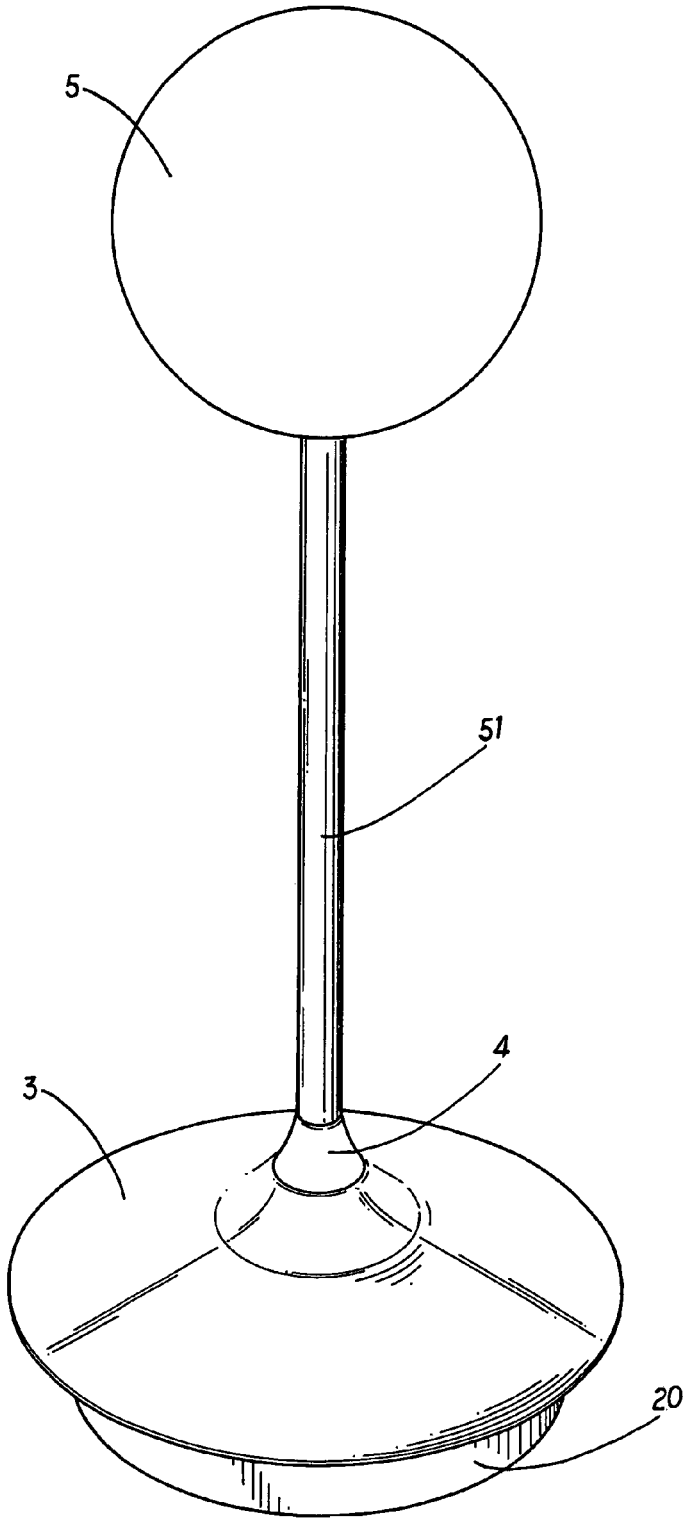
FIG. 3 is an assembled perspective view of the present invention.
Figure 4:
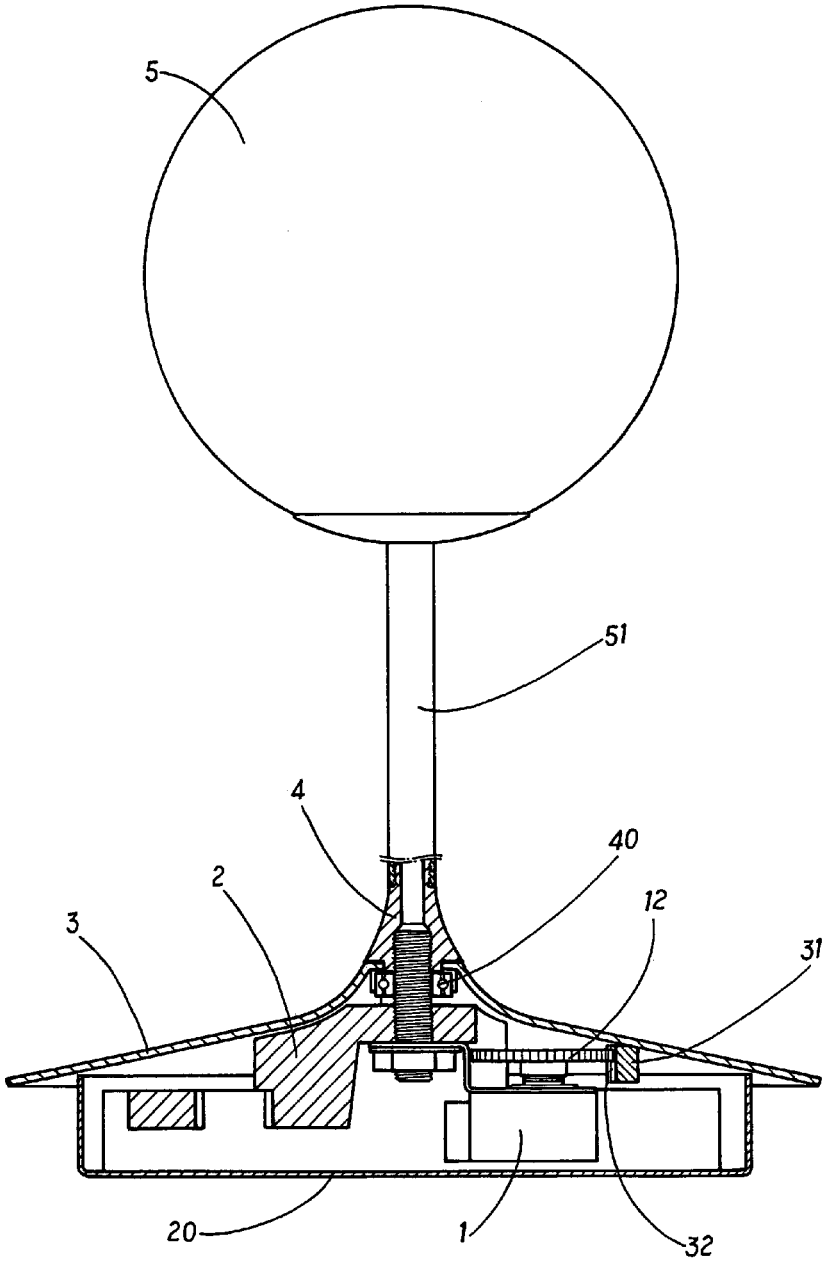
FIG. 4 is a schematic cross view of the present invention.
Figure 5:
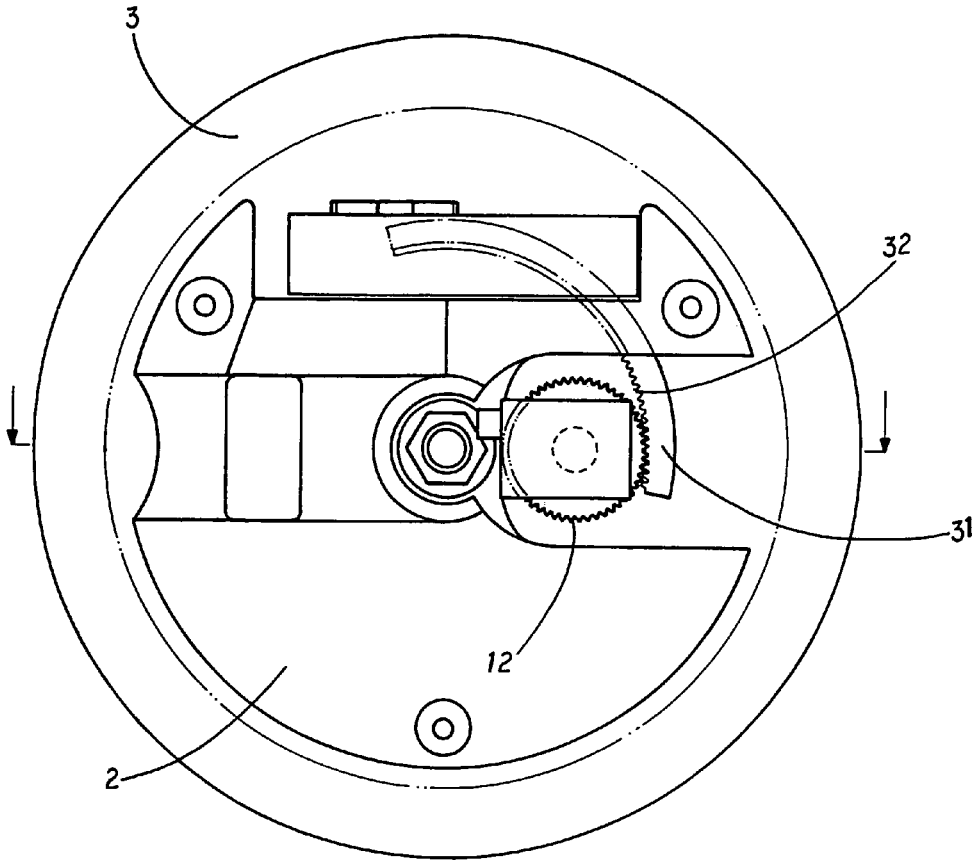
FIG. 5 shows the structure of the upper cover and the seat of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 2 to 5, the present invention has the following elements.

A tube body 51 is engaged with a connector 40. A screw is screwed into a lower side of the connector 40. A lamp 5 is installed at a top of the tube body 51.

An upper cover 3 is located below the connector 4.

A bearing 40 is installed below the upper cover 3 and between the connector 4 and the upper cover 3. An arc strip 31 is protruded from an inner surface of the upper cover 3. The arc strip 31 has teeth 31.

A seat 2 is installed between the upper cover 3 and the bottom cover 20. An inner side of the arc strip 31 has teeth 32.

Figure 6:
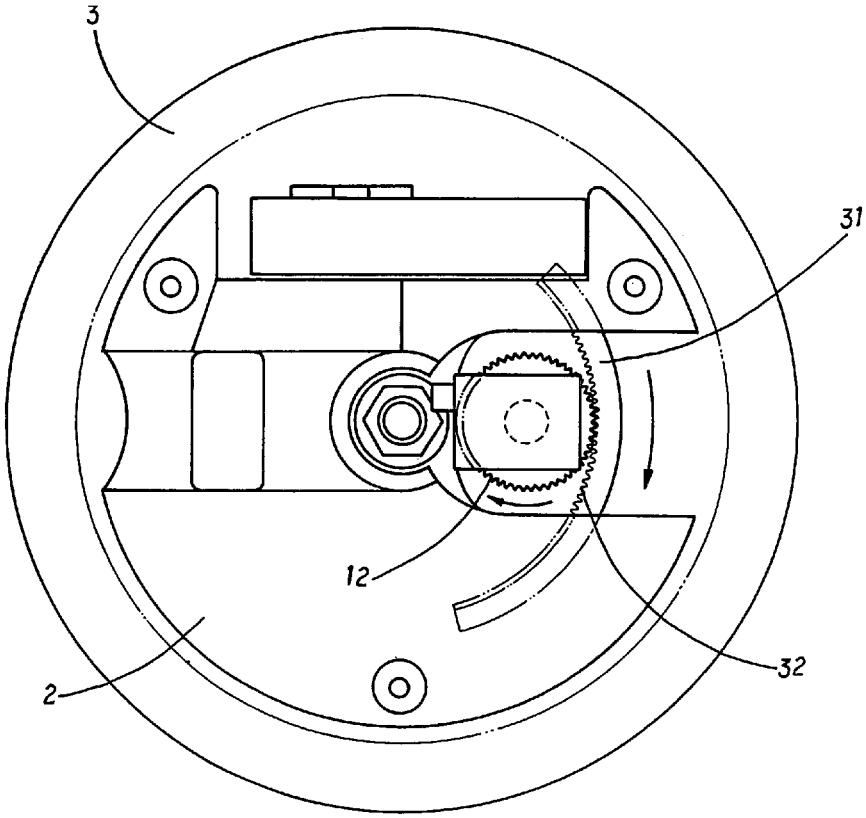
FIG. 6 is a schematic view showing the operation of the present invention.

A locking piece 6 is installed between the seat 2 and the bottom cover 20. A button 11 is installed to one side the locking piece 6. The button 11 has teeth 12. The teeth 12 of the button 12 is engaged to the teeth 32 of the arc strip 31. The button 11 resists against the arc strip 31. The button 11 is driven to rotate by the arc strip 31 (see FIGS. 5 and 6). The button 11 has a teethed through hole 13; and an inner periphery of the teeth through hole 13 is teethed.

A light adjuster 1 is installed below the button 11 and aside the locking piece 6. The light adjuster 1 has a teeth projection 16. A periphery of the teethed projection 16 is teethed. The teethed projection 16 is located within and engaged to the teethed through hole 13. The rotation of the button 11 will drive the light adjusted. The actuation of the light adjuster 1 is controllable by the button 11. An O ring 15 is located between the button 11 and the light adjuster 1;

Thereby, the user can push the upper cover 3 to drive the button 11 to rotate with a small force so as to control the actuation and de-actuation of the light adjuster 1. Moreover, since the light adjuster 1 is installed within the upper cover 3 and the bottom cover 20 so as to be fixed firmly and the present invention has a beautiful outlook.

Figure 7:
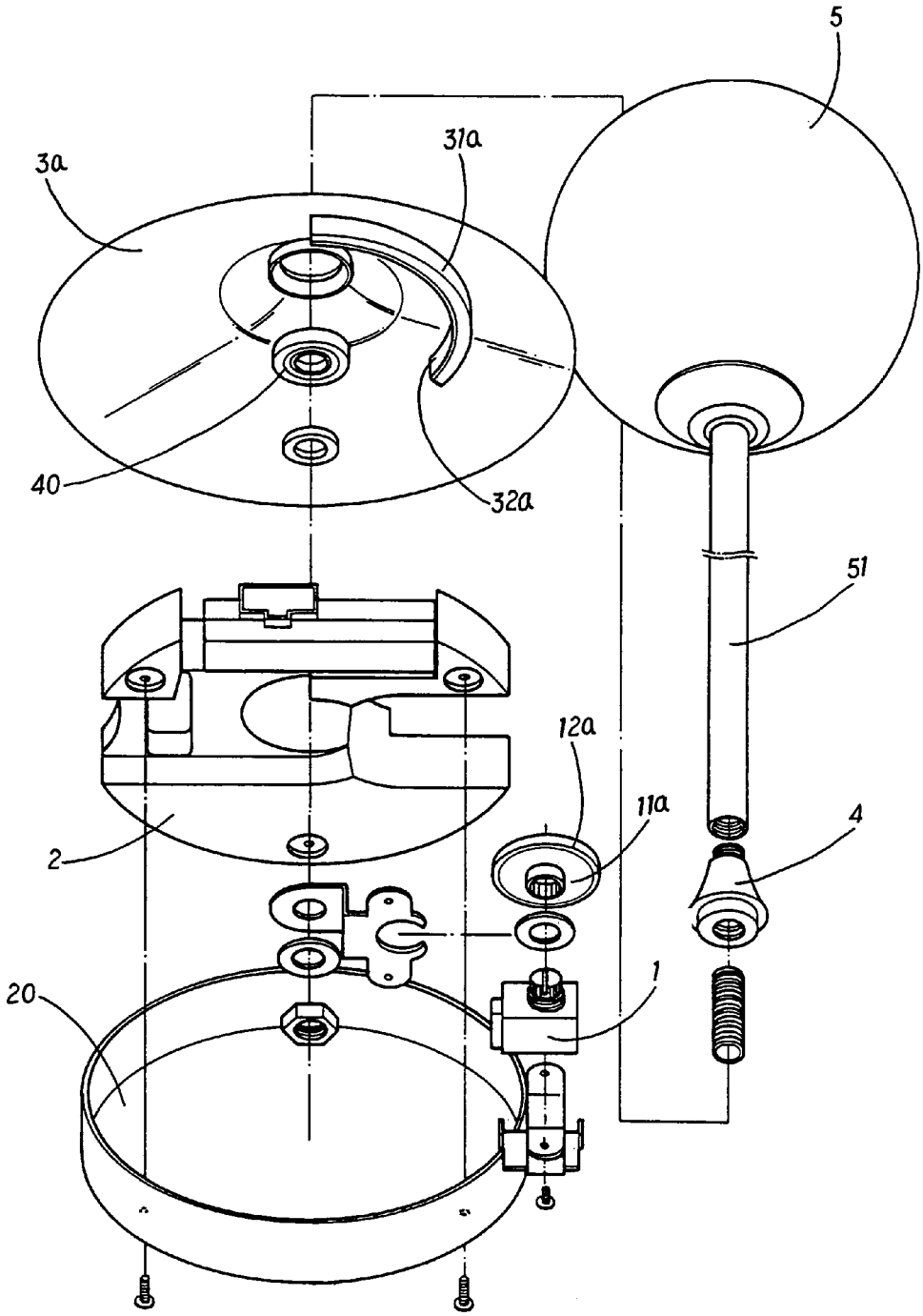
FIG. 7 is an exploded perspective view of another embodiment of the present invention.
Figure 8:
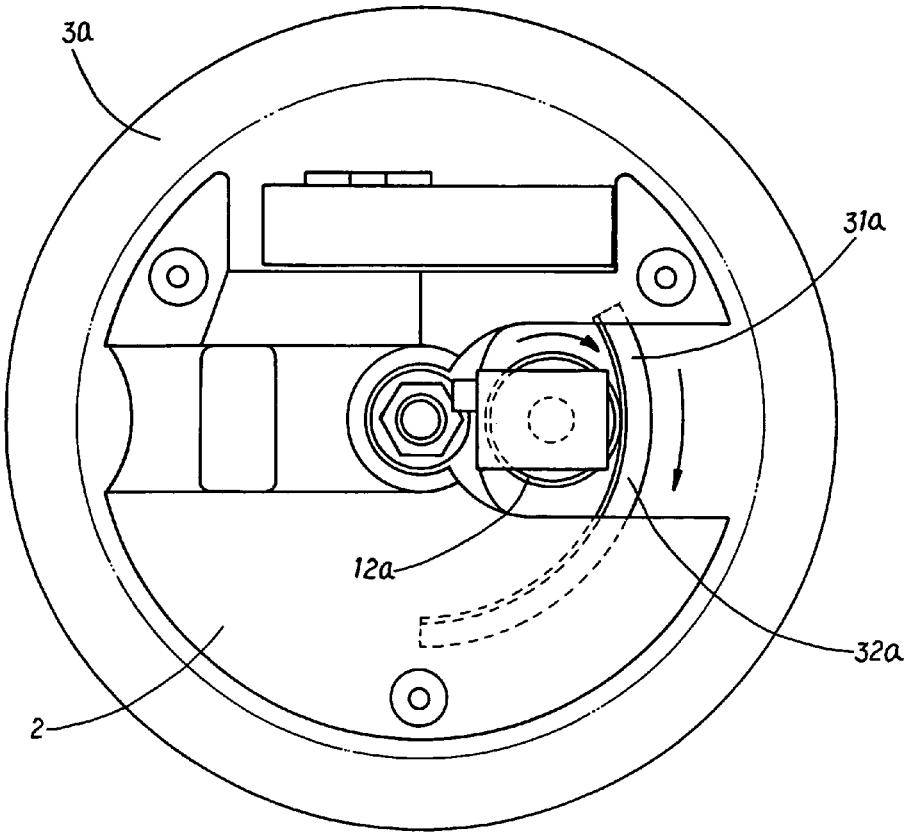
FIG. 8 is a schematic view showing the operation of the embodiment of FIG. 7.

Referring to FIGS. 7, 8, another embodiment of the present invention is illustrated. In this embodiment, the arc strip 31*a* is adhered with a sticky sheet 32*a*. A periphery of the button 11*a* is adhered with a sticky ring 2*a*. When the upper cover 3 rotates, the arc strip 31*a* will drive the button 11*a* to rotate so as to drive the light adjuster 1.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A rotation-controlled device for controlling actuation and de-actuation of the lamp comprising:

an upper cover;

an arc strip installed to an inner surface of the upper cover; an inner side of the arc strip having teeth;

a seat installed below the upper cover by using a connector;

a button installed to the seat and resisting against the arc strip; an out periphery of the button being formed with teeth: the teeth of the button being engaged to the teeth of the arc strip, and thus the button will be driven to rotate by rotating the arc strip; the button having a teethed through hole; an inner periphery of the teeth through hole being teethed; and a light adjuster installed below the button; the light adjuster having a teeth projection; a periphery of the teethed projection being teethed; the teethed projection being located within and engaged to the teethed through hole; the rotation of the button will drive the light adjusted and thus the actuation of the light adjuster being controllable by the button, an O ring being located between the button and the light adjuster;

wherein by rotating the upper cover, the arc strip will also rotate to drive the button to rotate, and thus the light adjuster is actuated or de-actuated.

2. The rotation-controlled device as claimed in claim 1, wherein a bearing is installed below the upper cover and between the connector and the upper cover.

3. The rotation-controlled device as claimed in claim 1, wherein a bottom cover is installed below the seat.

4. The rotation-controlled device as claimed in claim 1, wherein a lamp is installed to a tube body; and the upper cover is located below the tube body.

* * * * *